US012114772B2

(12) United States Patent
Håkansson

(10) Patent No.: US 12,114,772 B2
(45) Date of Patent: Oct. 15, 2024

(54) METHOD OF MANUFACTURING A BASE PLATE MEMBER FOR A TABLE AND A PRODUCT THEREOF

(71) Applicant: ROL ERGO AB, Jönköping (SE)

(72) Inventor: Eskil Håkansson, Jönköping (SE)

(73) Assignee: ROL ERGO AB, Jönköping (SE)

( * ) Notice: Subject to any disclaimer, the term of this patent is extended or adjusted under 35 U.S.C. 154(b) by 243 days.

(21) Appl. No.: 17/615,091

(22) PCT Filed: Jun. 4, 2020

(86) PCT No.: PCT/EP2020/065435
§ 371 (c)(1),
(2) Date: Nov. 29, 2021

(87) PCT Pub. No.: WO2020/245249
PCT Pub. Date: Dec. 10, 2020

(65) Prior Publication Data

US 2022/0218107 A1 Jul. 14, 2022

(30) Foreign Application Priority Data

Jun. 5, 2019 (EP) ..... 19178443

(51) Int. Cl.
*A47B 91/00* (2006.01)
*A47B 96/20* (2006.01)

(52) U.S. Cl.
CPC ..... *A47B 91/005* (2013.01); *A47B 96/20* (2013.01)

(58) Field of Classification Search
CPC ..... A47B 91/00; A47B 91/005; A47B 96/20
See application file for complete search history.

(56) References Cited

U.S. PATENT DOCUMENTS 4,512,543 A * 4/1985 Petrick ..... F16M 11/22 248/172
4,850,162 A 7/1989 Albrecht
5,746,034 A * 5/1998 Luchetti ..... E04B 2/7453 52/36.6

(Continued)

FOREIGN PATENT DOCUMENTS

DE 30 28 552 A1 2/1982
EP 1 532 893 A1 5/2005

(Continued)

OTHER PUBLICATIONS

International Search Report and Written Opinion for PCT/EP2020/065435, mailed Jun. 26, 2020.

*Primary Examiner* — Monica E Millner
(74) *Attorney, Agent, or Firm* — MARSHALL, GERSTEIN & BORUN LLP

(57) ABSTRACT

A method (10) of manufacturing a furniture base plate member includes the steps of providing a hollow longitudinally elongated metal profile roll formed from a sheet of metal, which includes an upper side and a lower side; pressing the upper side and the lower side of the metal profile against each other, such that at least one section of the upper side and the lower side abuts each other, such that two channels are formed by said pressing and having at least one opening at each longitudinal end of the metal profile; and arrange support members having insertion members extending into said the longitudinal channels at said openings.

10 Claims, 6 Drawing Sheets

(56) References Cited

U.S. PATENT DOCUMENTS

| | | | | | |
|---|---|---|---|---|---|
| 5,984,417 | A * | 11/1999 | Wang | A47C 11/005 | 297/440.22 |
| 6,669,163 | B2 * | 12/2003 | Davis, Jr. | F16M 7/00 | 52/126.5 |
| 6,848,589 | B2 * | 2/2005 | Wood | A47B 91/00 | 248/220.21 |
| 10,442,503 | B2 * | 10/2019 | Shearer | B63B 17/02 | |
| 10,989,240 | B2 * | 4/2021 | Self | F16B 12/48 | |
| 11,384,782 | B2 * | 7/2022 | Pathiratne | F16B 12/38 | |
| 2002/0040667 | A1 * | 4/2002 | Birsel | A47B 21/00 | 108/25 |
| 2009/0178596 | A1 * | 7/2009 | Skiba | A47B 9/14 | 108/149 |
| 2009/0294391 | A1 * | 12/2009 | Goldin | A47B 96/021 | 211/134 |
| 2012/0193503 | A1 * | 8/2012 | Pike | A47B 13/02 | 248/560 |
| 2018/0055237 | A1 * | 3/2018 | Odutayo | A47C 7/002 | |

FOREIGN PATENT DOCUMENTS

| | | | | |
|---|---|---|---|---|
| EP | 1 917 887 | A1 | 5/2008 | |
| EP | 2169240 | A1 * | 3/2010 | A47B 57/26 |

* cited by examiner

METHOD OF MANUFACTURING A BASE PLATE MEMBER FOR A TABLE AND A PRODUCT THEREOF

TECHNICAL FIELD

The present disclosure relates to a method of manufacturing a base plate member for a table or desk, and a product thereof.

BACKGROUND

In some tables or desks configurations, such as height-adjustable tables or desks, the legs of the tables or desks are connected to a set of base plate members. Thereby allowing for a table or desk with only two legs, which may be connected to the base plate members. This may reduce the weight of the table or desk, which is desirable. Further, it is important that a base plate member of a desk is a stable base or foundation for the table or desk.

In known solutions, a base plate member is provided comprising a plurality of elongated metal profiles, which are welded together. However, the base plate member is unnecessarily heavy, and the manufacturing may comprise an unnecessary number of steps, which may be costly.

Consequently, an alternative solution is desired, facilitating the manufacturing of a stable and lightweight base plate member.

SUMMARY

It is an object of the present inventive concept to provide an improved solution that alleviates the mentioned drawbacks with present devices. Furthermore, it is an object to provide a method of manufacturing a stable and lightweight base plate member, that may reduce the cost of manufacturing. The inventive concept is defined by the appended independent claims, with embodiments being set forth in the appended dependent claims, in the following description and in the drawings.

This is provided in a first aspect of the inventive concept by a method of manufacturing a furniture base plate member. The method may comprise the step of providing a hollow longitudinally elongated metal profile roll formed from a sheet of metal. The metal profile may comprise an upper side and a lower side. The method may further comprise the step of pressing the upper side and the lower side of the metal profile against each other. The pressing may be done such that at least one section of the upper side and the lower side abuts each other. The pressing may further be done such that two longitudinal channels are formed along the longitudinal extension of the metal profile. The longitudinal channels comprise respective openings at each longitudinal end of the metal profile. The method may further comprise the step of arranging support members having insertion members at each longitudinal end such that the insertion members extend into the longitudinal channels at said openings.

The hollow longitudinally elongated metal profile prior to pressing may have any geometrical shape, such as square, elliptical, or circular. The lower side of the hollow longitudinally elongated metal profile may comprise a gap or seam between the lateral edges of the sheet of metal prior to roll forming. The lateral edges of the sheet of metal prior to roll forming may be in contact after roll forming. The step of pressing the upper side and the lower side of the metal profile against each other may be done perpendicularly with regards to the gap of the hollow longitudinally elongated metal profile. The at least one section may comprise the entire base plate member, except for the two channels. The least one section may comprise portions of different thickness. The channels may have any cross-sectional shape. The shape may be configured for arranging a support member with insertion member of a predetermined shape. The support member may be configured to be compressed when arranged in the at least opening, thereby fastening the support member. The support member may comprise an insertion member configured to be inserted into the at least one opening so as to arrange the support member in the at least on opening. The insertion member may be configured to be at least slightly compressed when inserted into the at least one opening. The support member, or at least the insertion member, may be made of plastics material.

The at least one longitudinal channel may increase the structural integrity of the base plate member, thereby increasing the stability of the base plate member. The at least one longitudinal channel may be hollow, and may therefore increase the stability while maintaining the low weight of the base plate member. The at least one longitudinal channel may be formed between the upper side of the metal profile and the lower side of the metal profile. The at least one longitudinal channel may have a profile with a square shape. The shape of the profile of the longitudinal channel may have any space, such as square, square with rounded corners, triangular, half-circular. The at least one longitudinal channel may be conjoined with the at least one opening at each longitudinal end. The at least one longitudinal channel may comprise holes through the lower side of the metal profile. When the metal profile has been pressed, the at least one opening may be formed as at least one longitudinal channel extending along the longitudinal extension of the metal profile. In one embodiment, the step of pressing may provide that two longitudinal channels are formed with the at least one opening at each longitudinal end of the metal profile. In one embodiment, two longitudinal channels may be formed with the at least one section extending along the longitudinal extension of the metal profile between the two longitudinal channels. In an embodiment with two longitudinal channels, a support member may comprise two insertion members configured to be inserted into the two openings or two channels at a longitudinal end of the metal profile. In one embodiment one support member may be arranged at each longitudinal end of the metal profile.

The support member may comprise a foot member. The foot member may be a part of the support member configured to support the support member and the base plate member on a floor or ground. The foot member may be of a plastic material.

In one embodiment, the support member may be configured for fastening of a foot member.

The foot member may be arranged in a fastening hole in the base plate member or the support member. The foot member may increase the stability of the base plate member. The fastening hole may be scored, and arranged to fasten a foot member which may comprise a screw arranged for fastening into the fastening hole. The foot member may comprise a fastening member configured to be arranged in the fastening hole. The fastening member may be configured to be compressed when arranged in the fastening hole, thereby fastening the fastening member in the fastening hole. The foot member may be arranged to adjust the depth of its penetration into the fastening hole. Thereby, multiple foot members may be arranged at different depths into their respective fastening hole, which may increase the stability of the base plate member.

In a further embodiment, the at least one longitudinal channel may be arranged along an edge of the base plate member.

The base plate member may comprise two longitudinal channels, one along each of the longitudinal edges of the base plate member.

In one embodiment, the at least one longitudinal channel may be arranged on the lower side of the base plate member. The base plate member may have an upper side and a lower side, and the at least one longitudinal channel may be arranged such that it protrudes on the lower side of the base plate member. The lower side may be a side facing a floor or ground surface when in use. The lower side may be a side on which a foot portion is configured to be arranged to support the base plate member.

In another embodiment, the method of manufacturing a furniture base plate member may further comprise the step of welding at least one of the at least one section.

The step of welding may further comprise welding together the gap or seam between the lateral edges of the sheet of metal prior to roll forming. The step of welding can comprise welding the entire at least one section, the entirety of one, two, three or more sections, or welding points of the at least one section.

In a further embodiment, the step of pressing may further provide at least one hole through the base plate member is formed.

The step of pressing may further be done such that two or four holes through the base plate member are formed. The at least one hole through the base plate member may be formed at a center of the base plate member.

In one embodiment, the at least one hole may be configured for fastening of a leg member.

The at least one hole may be threaded, such that screws or screw nuts may be screwed of the leg member may be screwed into the holes. The at least one hole may be adapted for fastening of a leg member with a nut.

According to a second aspect of the inventive concept, a furniture base plate member is provided. The base plate member comprises an elongated metal profile, comprising an upper side and a lower side; at least one first section, wherein the upper side and the lower side abuts each other; two longitudinal channels extending along the longitudinal extension of the metal profile, each longitudinal channel comprising at least one opening at each longitudinal end of the metal profile; and at least two support members arranged at respective longitudinal ends of the metal profile, wherein the support members comprises insertion members extending into the longitudinal channels at said openings.

In one embodiment, at least one of the at least one section may be welded together.

In one embodiment, the at least two support members may comprise a foot member.

In one embodiment, the base plate member may further comprise at least one hole configured for fastening of a leg member.

In one embodiment, the at least two support members may comprise an insertion member configured to extend into said at least one opening.

BRIEF DESCRIPTION OF THE DRAWINGS

The inventive concept will in the following be described in more detail with reference to the enclosed drawings, wherein.

DESCRIPTION OF EMBODIMENTS

Figure 1:
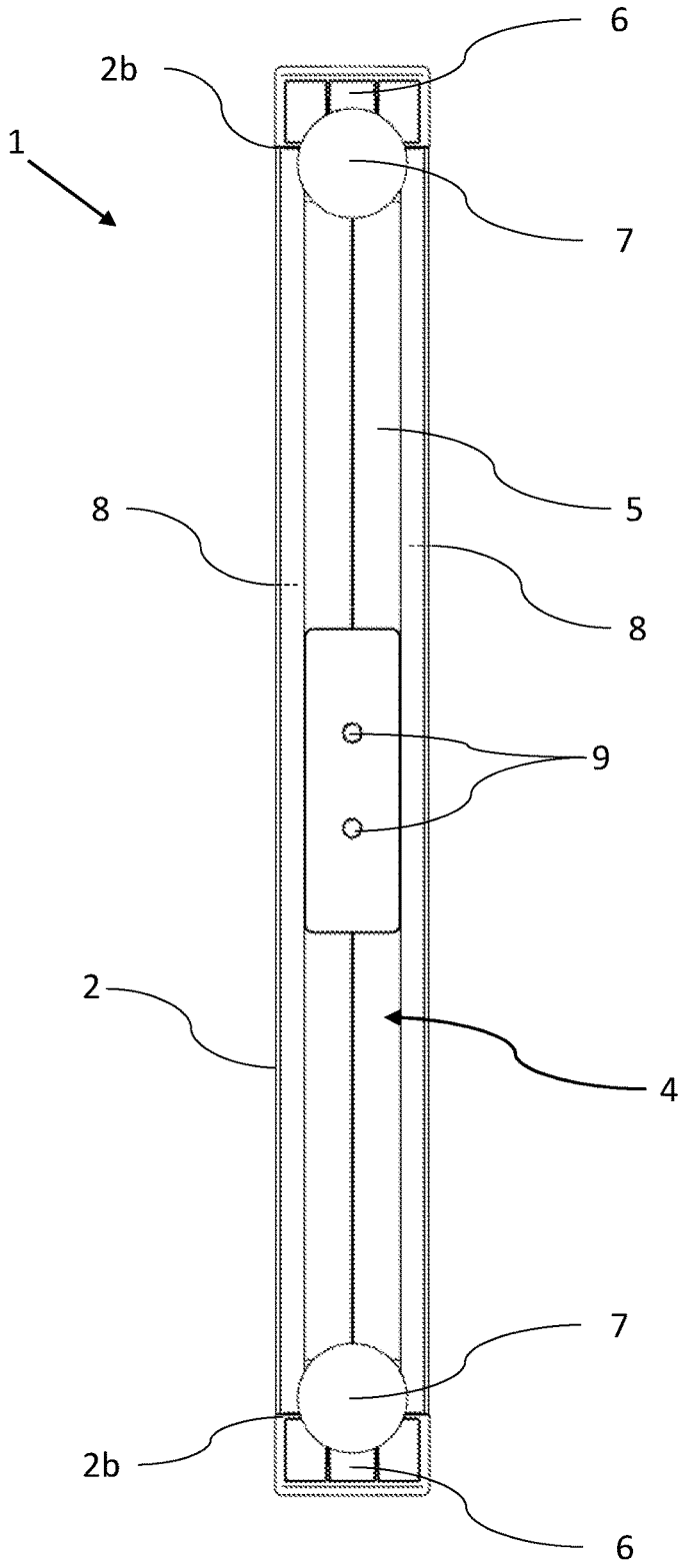
FIGS. 1-3 show perspective views of a furniture base plate member according to embodiments of the inventive concept.

The present inventive concept will be described more fully hereinafter with reference to the accompanying drawings, in which preferred embodiments of the inventive concept are shown. This inventive concept may, however, be embodied in many different forms and should not be construed as limited to the embodiments set forth herein; rather, these embodiments are provided so that this disclosure will be thorough and complete, and will fully convey the scope of the inventive concept to those skilled in the art. In the drawings, like numbers refer to like elements.

In the drawings and specification, there have been disclosed preferred embodiments and examples of the inventive concept and, although specific terms are employed, they are used in a generic and descriptive sense only and not for the purpose of limitation, the scope of the inventive concept being set forth in the following claims.

FIG. 1 illustrates a furniture base plate member 1. The base plate member 1 comprises an elongated metal profile 2. The elongated metal profile 2 comprises two longitudinal ends 2*b*, an upper side 3 (see FIG. 2) and a lower side 4. The base plate member 1 comprises a section 5 where the upper side 3 and the lower side 4 abuts each other. The section 5 comprises a portion which is thicker than the rest of the section 5, which is arranged in the middle of the lower side 4. The elongated metal profile 2 further comprises two openings, arranged at each longitudinal end 2*b* of the metal profile 2. Further, the furniture base plate member 1 comprises two support members 6, arranged in the openings arranged at each longitudinal end 2*b* of the metal profile 2. The shown support members 6 are configured for a foot member 7, and each support member 6 comprises said foot member 7. The base plate member 1 comprises two longitudinal channels 8, arranged along the base plate member 1. The longitudinal channels 8 are arranged along a longitudinal edge of the base plate member 1. The longitudinal channels 8 are formed between the upper side 3 and the lower side 4 of the metal profile 2. The longitudinal channels 8 are protruding from the lower side 4 of the baste plate member 1. The longitudinal channels 8 ends as openings at each longitudinal end 2*b* of the metal profile 2.

The base plate member 1 further comprises two holes 9, arranged through the base plate member 1. The two holes 9 are arranged along a central longitudinal axis of the base plate member 1, and are distanced at an equal distance along the longitudinal axis of the base plate member 1 from the center of the base plate member 1. The holes 9 are shown in FIG. 1 as arranged in the thicker portion of the section 5.

Figure 2:
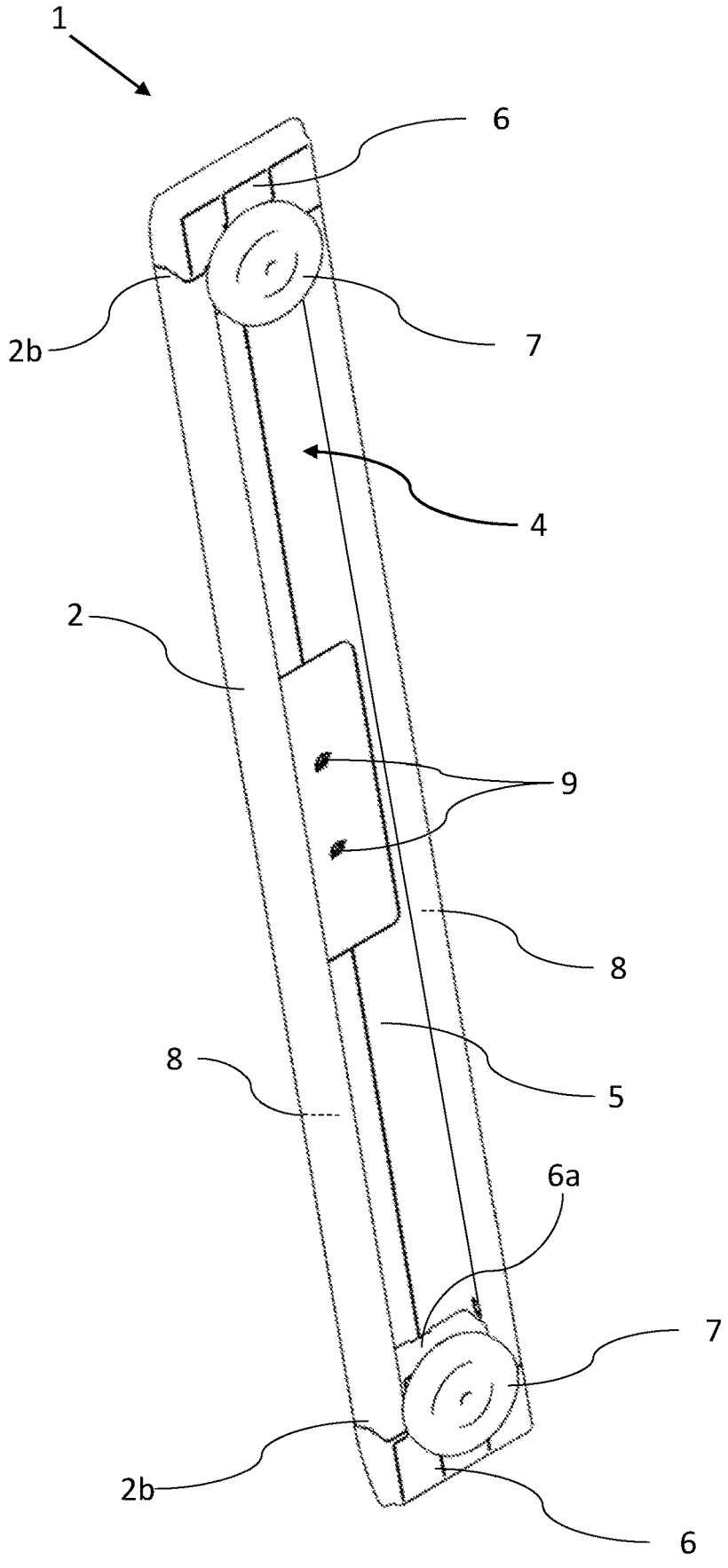

FIG. 2 illustrates a furniture base plate member 1, in a rotated position as compared to the illustration in FIG. 1. The furniture base plate member 1 in FIG. 2 shows all the features shown in FIG. 1. Further, the base plate member 1 in FIG. 2 shows the longitudinal channel 8 comprising a hole. In FIG. 2 the support member 6 arranged in the two openings 2*a*, formed as longitudinal channels 8, comprises an extending portion 6*a*, which extends longitudinally from the longitudinal end 2*b* inwards and between the two longitudinal channels 8. The foot member 7 is arranged in the extending portion 6*a* of the support member 6.

Figure 3:
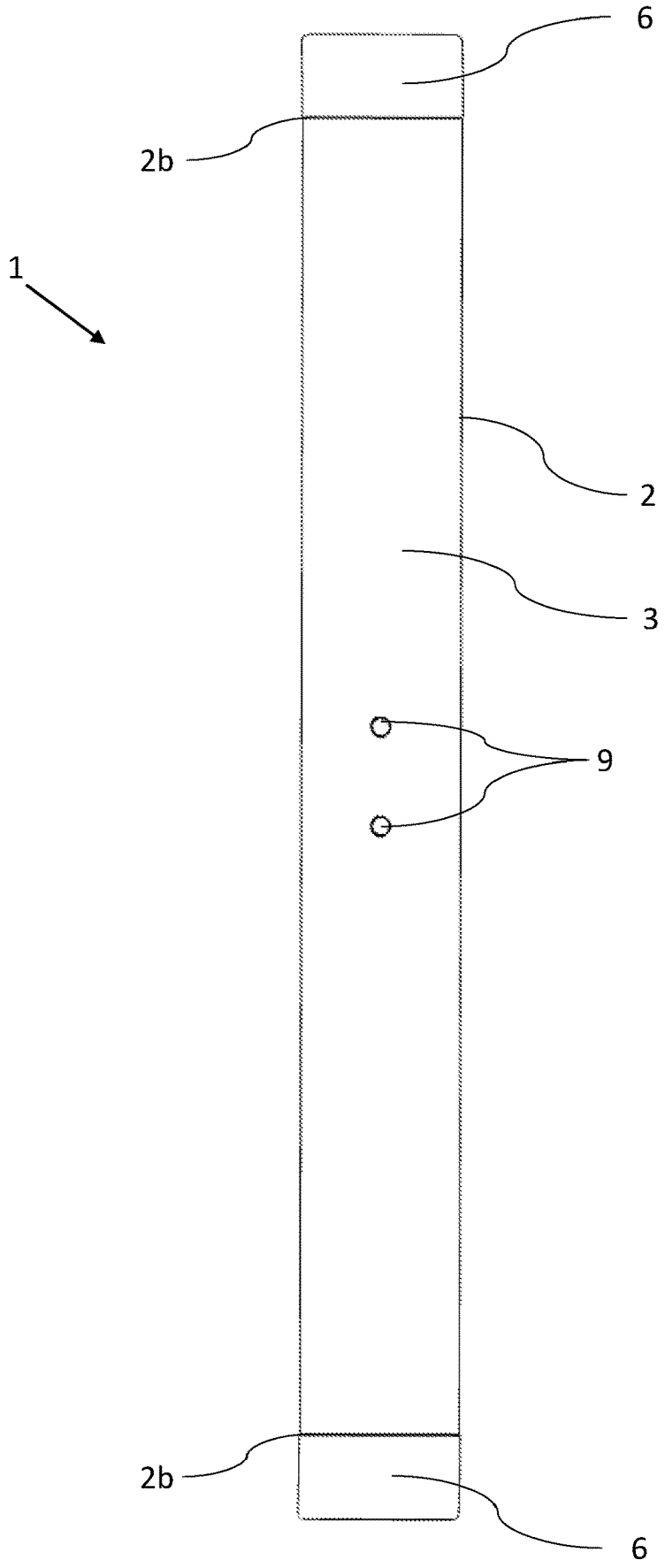

FIG. 3 illustrates a furniture base plate member 1, in a rotated position as compared to the illustrations in FIG. 1 and FIG. 2. The illustrated furniture base plate member 1 in FIG. 3 shows all the features shown in the illustrations in FIG. 1 and FIG. 2. Further, the furniture base plate member 1 in FIG. 2 shows an upper side 3 of the metal profile 2.

Figure 4:
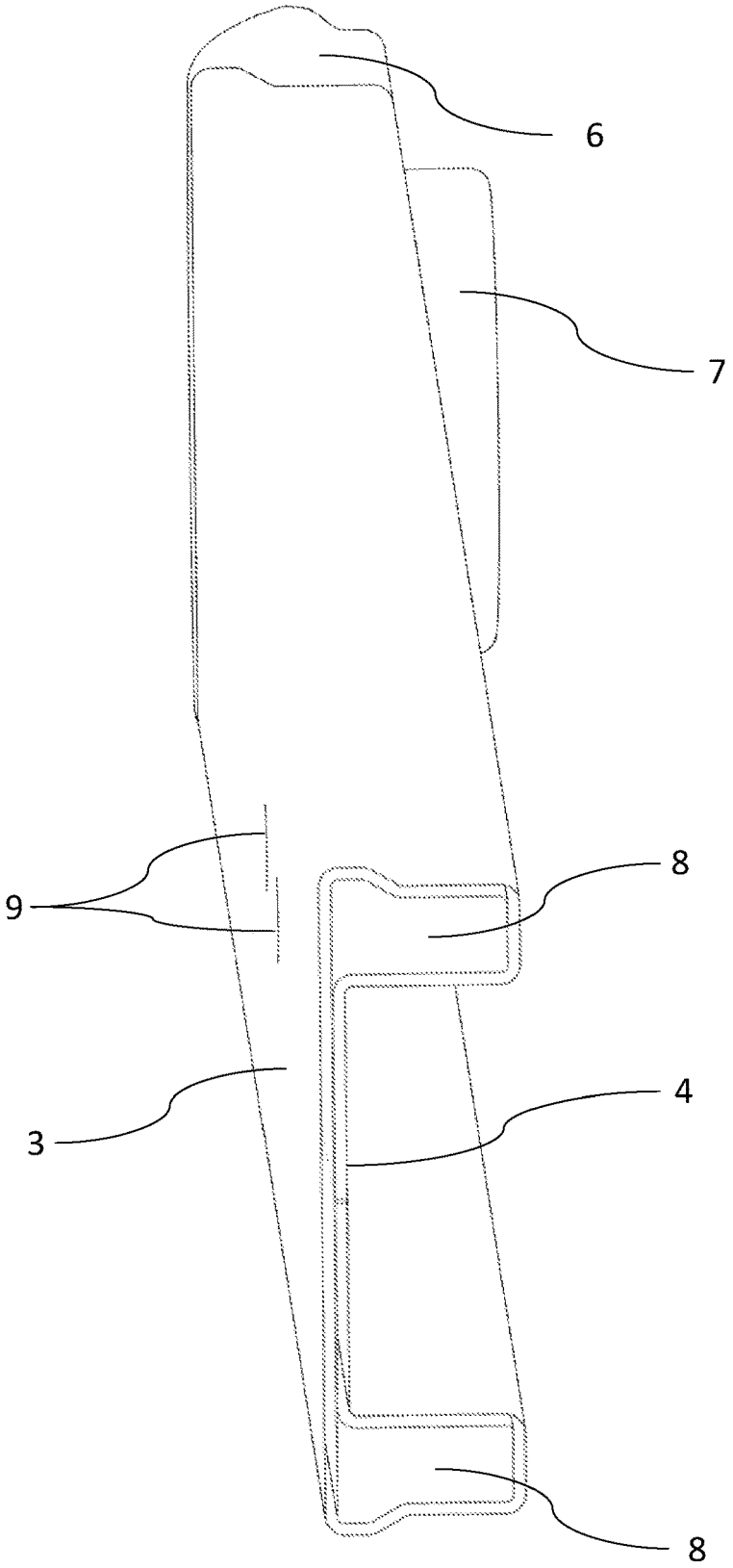
FIGS. 4-5 show cross-section views of a furniture base plate member according embodiments of the inventive concept.

FIG. 4 illustrates a furniture base plate member 1, in a cross-sectional perspective view. The illustrated furniture base plate member 1 in FIG. 4 shows all the features shown in the illustrations in FIGS. 1-3. Further, the furniture base plate member 1 in FIG. 4 shows two openings 2*a* at each longitudinal end 2*b* formed as two longitudinal channels 8. The shown longitudinal channels 8 extend along the longitudinal extension of the base plate member 1, and are arranged along the longitudinal edges of the base plate member 1. The longitudinal channels 8 are provided with a square shaped cross section. The longitudinal channels 8 may have the same cross-sectional shape along the entire longitudinal extension of the metal profile 2.

In FIG. 4 the lateral edges of the sheet of metal prior to roll forming are in contact on the lower side 4 of the base plate member 1.

Figure 5:
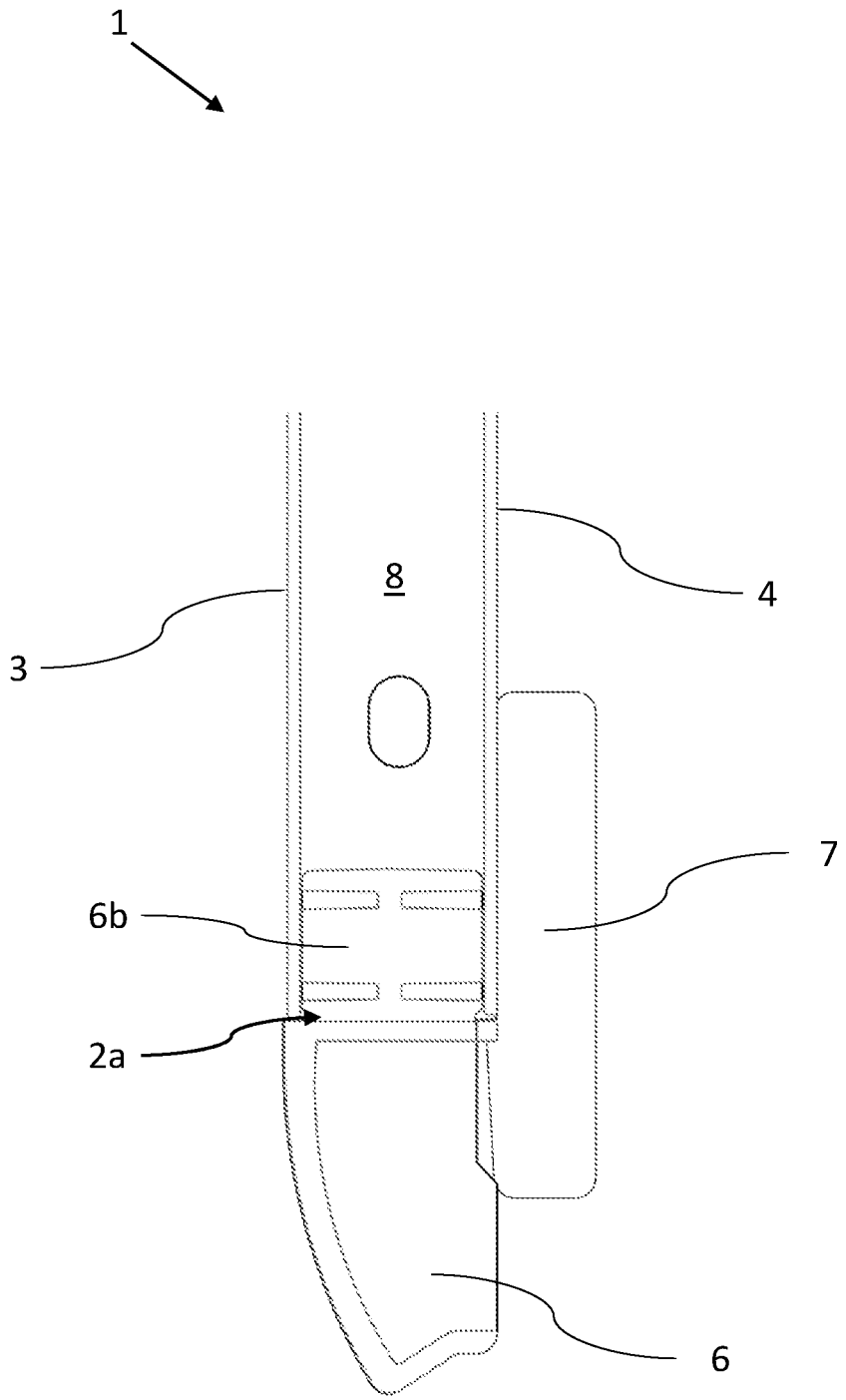

FIG. 5 illustrates a furniture base plate member 1, in a cross-sectional view. The illustrated furniture base plate member 1 in FIG. 5 shows all the features shown in the illustrations in FIGS. 1-4. Further, the furniture base plate member 1 in FIG. 5 shows a support member 6 arranged in two openings 2*a*, formed as two longitudinal channels 8, (see FIG. 4). The support member 6 is shown as inserted into the longitudinal channel 8. The support member 6 comprises insertion members 6*b*. The insertion member 6*b* may be of a plastic material. The insertion member 6*b* is inserted into the longitudinal channel 8, and is in contact with at least two inner surfaces of the longitudinal channel 8. The insertion member has a shape arranged to be compressed when inserted. The shape of the insertion member is no way limited to the illustration in FIG. 5 and may have any shape. The foot member 7 is fastened to the extending portion 6*a* (not shown), which extends longitudinally from the longitudinal end 2*b* inwards and between the two longitudinal channels 8, of the support member 6.

Figure 6:
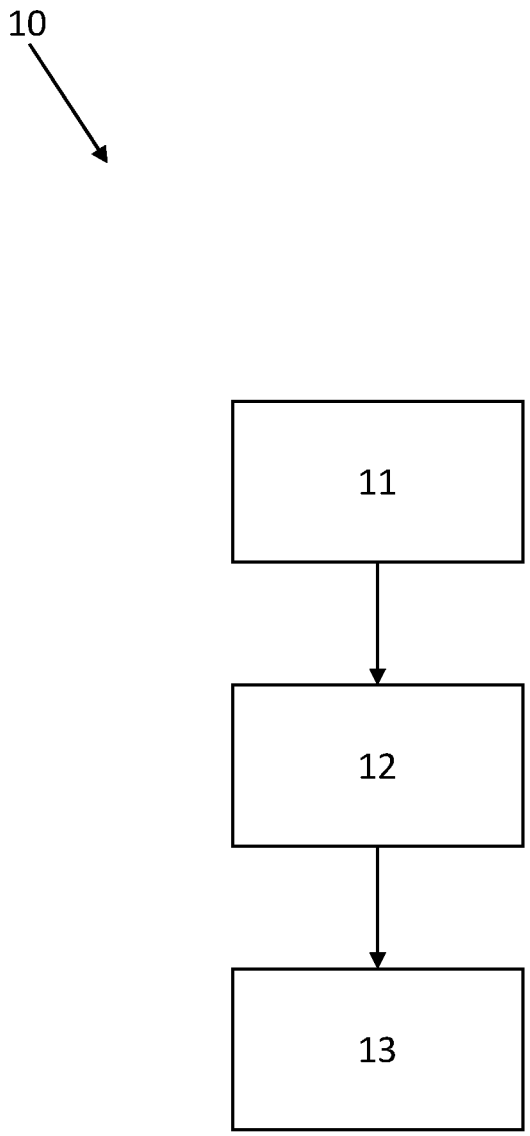
FIG. 6 shows a flow chart of a method of manufacturing a furniture base plate member according to an embodiment of the inventive concept.

FIG. 6 illustrates a flow chart of a method 10 of manufacturing a furniture base plate member. The method 10 comprises the steps of providing 11 a hollow longitudinally elongated metal profile 2 roll formed from a sheet of metal, comprising an upper side 3 and a lower side 4, pressing 12 the upper side 3 and the lower side 4 of the metal profile 2 against each other, such that at least one section 5 of the upper side 3 and the lower side 4 abuts each other, such that at least one opening is formed by said pressing at each longitudinal end 2*b* of the metal profile 2, and arrange 13 a support member 6 in said at least one opening at each longitudinal end 2*b*.

The invention claimed is:

1. A method of manufacturing a furniture base plate member, wherein the method comprises the steps of:

providing a hollow longitudinally elongated metal profile roll formed from a sheet of metal, comprising an upper side and a lower side;

pressing the upper side and the lower side of the metal profile against each other, such that at least one section of the upper side and the lower side abut each other, and such that two longitudinal channels extending along the longitudinal extension of the metal profile are formed by said pressing with said section between the two longitudinal channels, wherein the longitudinal channels include longitudinal ends, each of the longitudinal ends having two openings at each longitudinal end of the metal profile; and arranging support members, each having two insertion members, at the longitudinal ends such that the insertion members extend into the longitudinal channels at said openings, and wherein the support members and openings are arranged so that the two insertion members are inserted longitudinally into the longitudinal channels at said openings.

2. The method according to claim 1, wherein the support member comprises a foot member.

3. The method according to claim 1, wherein the support member is configured for fastening of a foot member.

4. The method according to claim 1, wherein at least one longitudinal channel is arranged along an edge of the metal profile.

5. The method according to claim 1, wherein the at least one longitudinal channel is arranged on the lower side of the metal profile.

6. The method according to claim 1, further comprising the step of welding at least one of the at least one section.

7. The method according to claim 1, wherein pressing is further done such that at least one hole through the base plate member is formed.

8. A furniture base plate member comprising an elongated metal profile, comprising an upper side and a lower side;

at least one first section, wherein the upper side and the lower side abut each other;

two longitudinal channels extending along the longitudinal extension of the metal profile with said section between the two longitudinal channels, each longitudinal channel including longitudinal ends, each of the longitudinal ends including openings at each longitudinal end of the metal profile; and two support members, arranged at respective longitudinal ends of the metal profile, wherein the support members comprise two insertion members extending into the longitudinal channels at said openings, and wherein the support members and the openings are arranged so that the two insertion members are inserted longitudinally into the longitudinal channels at said openings.

9. The furniture base plate member according to claim 8, wherein at least one of the at least one section is welded together.

10. The furniture base plate member according to claim 8, wherein the at least two support members comprises a foot member.

* * * * *